US010882337B1

(12) United States Patent
Condello et al.

(10) Patent No.: US 10,882,337 B1
(45) Date of Patent: Jan. 5, 2021

(54) SYSTEM AND METHOD FOR PRODUCING HIGH QUALITY IMAGES WITH ULTRAVIOLET CURABLE INKS IN A PRINTER

(71) Applicant: Xerox Corporation, Norwalk, CT (US)

(72) Inventors: Anthony S. Condello, Webster, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/538,976

(22) Filed: Aug. 13, 2019

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/0015; B41J 2/01; B41M 7/0081; C09D 11/101
USPC ..... 347/101, 102
See application file for complete search history.

(56) References Cited

U.S. PATENT DOCUMENTS

| | | | | |
|---|---|---|---|---|
| 8,177,349 | B2 | 5/2012 | Fukui | |
| 8,496,325 | B2 * | 7/2013 | Mitsuzawa | B41M 7/0081 347/102 |
| 8,602,548 | B2 * | 12/2013 | Miyabayashi | B41J 2/01 347/102 |
| 9,573,391 | B2 | 2/2017 | Ma et al. | |
| 2013/0113868 | A1 | 5/2013 | Veis | |

* cited by examiner

*Primary Examiner* — An H Do
(74) *Attorney, Agent, or Firm* — Maginot Moore & Beck LLP

(57) ABSTRACT

A printer includes a first printhead operatively connected to a source of ultraviolet (UV) curable ink having a first color, a first source of UV radiation following the first printhead in the process direction by a first predetermined distance, a second printhead operatively connected to the source of UV curable ink having the first color, and a second source of UV radiation following the second printhead in the process direction by a second predetermined distance that is greater than the firsts predetermined distance. The first predetermined distance enables the first source of UV radiation to fix the UV curable ink ejected by the first printhead before passing the second printhead and the second predetermined distance enables the ink ejected by the second printhead to flow over a portion of the substrate before the second source of UV radiation fixes the UV curable ink ejected by the second printhead.

28 Claims, 4 Drawing Sheets

SYSTEM AND METHOD FOR PRODUCING HIGH QUALITY IMAGES WITH ULTRAVIOLET CURABLE INKS IN A PRINTER

TECHNICAL FIELD

This disclosure relates generally to inkjet printers, and more particularly, to inkjet printers that use ultraviolet (UV) curable inks to produce text and images on substrates.

BACKGROUND

Producing high quality images on substrates in printers with aqueous inks that are liquid at room temperature can be very challenging. Compounding these challenges are non-porous substrates, such as many plastics, metals, glass, ceramics, and the like. These substrates do not easily enable the ejected aqueous ink to anchor onto the substrate. The unanchored ink can flow about the surface and combine in ways that can adversely impact the quality of the ink images. One problem arises because different images require different amounts of ink flow to look their best. For example, very fine features and details benefit from the ejected aqueous ink being at least partially dried as soon as possible, while large solid areas containing multiple colors of aqueous ink forming secondary and tertiary colors can appear more uniform and attractive when the inks are allowed a certain amount of time to flow and mix before any drying takes place.

To address this problem, UV inks have been developed that have the unique advantage of including photo-sensitive materials so the inks can be cured with UV radiation and stabilized on the substrates. Consequently, these UV inks do not require drying. Unlike the aqueous inks that require the relatively time-consuming evaporation of water and co-solvents from the inks, UV inks can solidify almost instantaneously. While UV inks address the problem of run-away ink, especially on non-porous substrates, the solidification of ink drops on some substrates can occur too quickly. In these circumstances, a certain amount of ink spread is needed to reduce defects in the ink images since the ink has not flowed enough to cover an image area adequately. For example, a certain amount of ink spreading is needed to help hide missing ink not ejected by inoperative inkjets to help maintain the uniformity of solid areas and achieve accurate color production in these solid uniform areas. Being able to flexibly alter the degree of UV curing for different portions of ink images would be beneficial.

SUMMARY

A new printer is configured to provide varying degrees of UV radiation exposure at different times during image printing to improve the sharpness of fine image features and to establish uniform solid areas with accurate formation of colors in those areas. The printer includes a first printhead operatively connected to a source of ultraviolet (UV) curable ink having a first color, the printhead being configured to eject the UV curable ink having the first color onto a substrate as the substrate passes the printhead in a process direction, a first source of UV radiation following the first printhead in the process direction by a first predetermined distance so the UV curable ink ejected by the first printhead is fixed by the UV radiation from the first source of UV radiation before the substrate moves past the first source of UV radiation, a second printhead operatively connected to the source of UV curable ink having the first color, the second printhead being positioned to eject the UV curable ink having the first color onto the substrate after the first printhead has ejected the UV curable ink having the first color onto the substrate and the first source of UV radiation exposes the UV curable ink ejected by the first printhead to UV radiation, and a second source of UV radiation following the second printhead in the process direction and being separated from the second printhead in the process direction by a second predetermined distance that is greater than the first predetermined distance so the UV curable ink ejected by the second printhead spreads over a portion of the substrate before the second source of UV radiation fixes the UV curable ink ejected by the second printhead to the substrate.

A method of printer operation provides varying degrees of UV radiation exposure at different times during image printing to improve the sharpness of fine image features and to establish uniform solid areas with accurate formation of colors in those areas. The method includes operating with a controller a first source of UV radiation that follows a first printhead in a process direction by a first predetermined distance to fix UV curable ink ejected by the first printhead onto a substrate before the substrate moves past the first source of UV radiation and operating with a controller a second source of UV radiation following a second printhead in the process direction that is separated from the second printhead in the process direction by a second predetermined distance that is greater than the first predetermined distance to fix the UV curable ink ejected by the second printhead after the UV curable ink spreads over a portion of the substrate.

Another embodiment of the new printer is configured to provide varying degrees of UV radiation exposure at different times during image printing to improve the sharpness of fine image features and to establish uniform solid areas with accurate formation of colors in those areas. The alternative embodiment of the printer includes a first printhead operatively connected to a source of ultraviolet (UV) curable ink having a first color, the first printhead being configured to eject the UV curable ink having the first color onto a substrate as the substrate passes the first printhead in a process direction, a first source of UV radiation following the first printhead in the process direction by a first predetermined distance, the first source of UV radiation being configured with a plurality of UV emitters that are independently operable so at least one UV emitter is operated to expose at least one area of the substrate printed with the UV curable ink ejected by the first printhead to fix the UV curable ink in the at least one area before the substrate moves past the first source of UV radiation and the UV curable ink ejected by the first printhead on at least one other area of the substrate spreads as the substrate passes the first source of UV radiation, and a second source of UV radiation following the first source of UV radiation in the process direction and being separated from the first source of UV radiation in the process direction by a second predetermined distance that is greater than the first predetermined distance, the second source of UV radiation being configured to expose an entire width of the substrate in a cross-process direction so the UV curable ink ejected by the first printhead in the at least one other area is fixed as the substrate passes the second source of UV radiation.

BRIEF DESCRIPTION OF THE DRAWINGS

The foregoing aspects and other features of a printer that provides varying degrees of UV radiation exposure at different times during image printing to improve the sharpness of fine image features and to establish uniform solid areas with accurate formation of colors in those areas are explained in the following description, taken in connection with the accompanying drawings.

DETAILED DESCRIPTION

Figure 1:
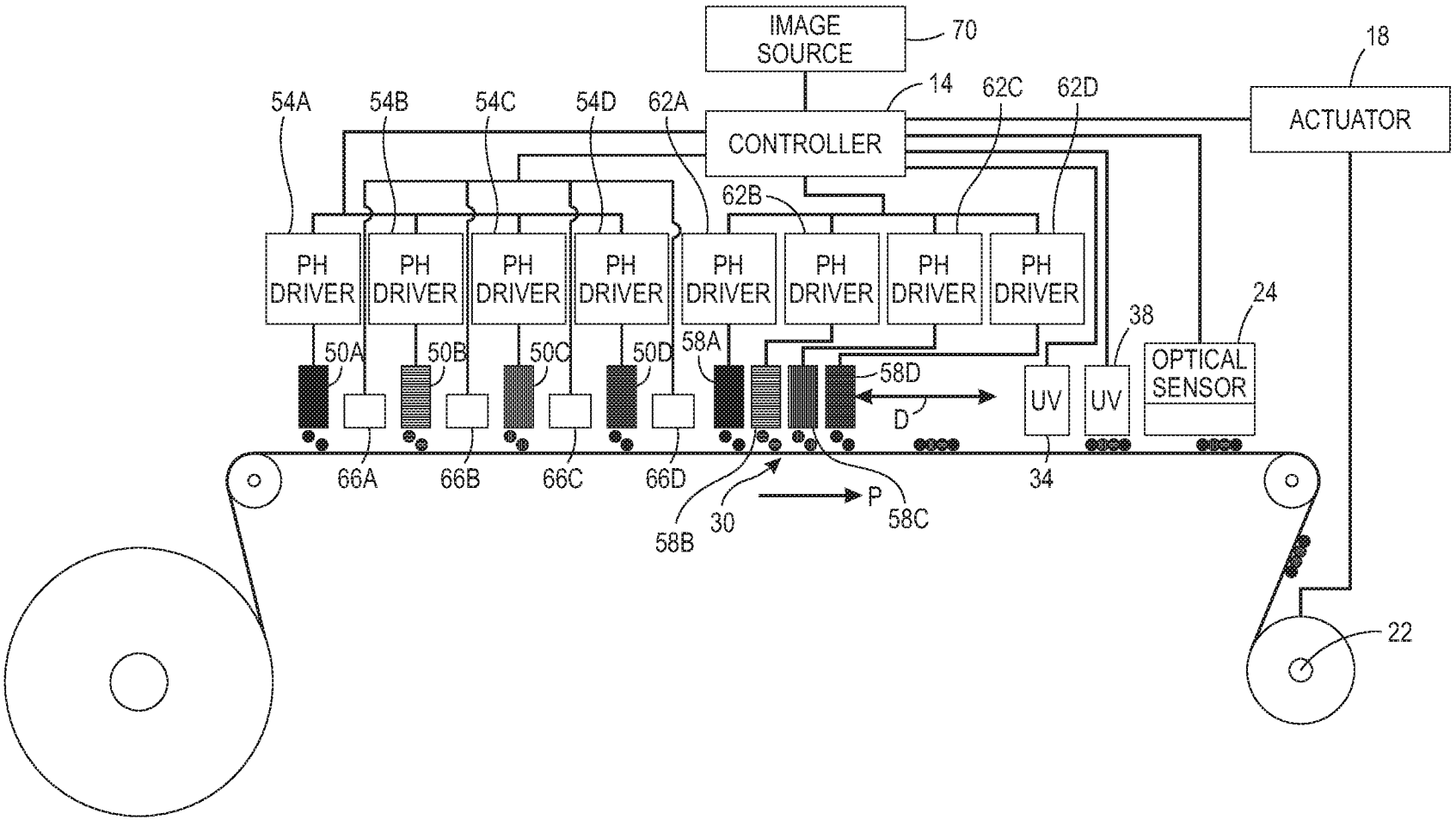
FIG. 1 is a diagram of a printer that provides varying degrees of UV radiation exposure at different times during image printing to improve the sharpness of fine image features and to establish uniform solid areas with accurate formation of colors in those areas.

For a general understanding of the present embodiments, reference is made to the drawings. In the drawings, like reference numerals have been used throughout to designate like elements.

A printing system 10 configured to provide varying degrees of UV radiation exposure at different times during image printing to improve the sharpness of fine image features and to establish uniform solid areas with accurate formation of colors in those areas is shown in FIG. 1. The system 10 is a web printing system in which a controller 14 operates an actuator 18 to rotate a take-up shaft 22 after the web W has been fed through the system and a portion of the web is wrapped around the shaft 22. This rotation of the shaft 22 pulls the web through the system 10 past a first print zone 26 and then past a second print zone 30. The web W continues past a pair of UV radiation sources 34, 38, each of which emits UV radiation at a wavelength that is different than the wavelength of the UV emission of the other UV radiation source. In one embodiment, the UV radiation source 34 emits UV radiation with a wavelength of 395 nm, while the UV radiation source 38 emits UV radiation with a wavelength of 365 nm. The longer wavelength cures the underlaying layers of ink better than the shorter wavelength, while the shorter wavelength cures the upper layers better than the longer wavelength. Curing the underlying layers before curing the upper layers is the better order because curing the underlying layers is more difficult if the top layers are cured first. The UV radiation sources 34, 38 are separated from the last printhead in the second print zone 30 by a predetermined distance D. This distance D is empirically determined as a distance that is sufficient for the inks ejected by the printheads in the second print zone to flow over the surface of the web W so the ink is more uniform before the ink passes underneath the UV sources 34, 38 and is cured, which freezes the position of that ink. As used in this document, the term "flow" means that the ink expands beyond the landing side of a UV curable drop by more than the predetermined toleration parameter. The finished printed image then passes an optical sensor 24 that generates image data of the printed image so the image data can be analyzed by the controller 14 to determine with image quality is acceptable. The optical sensor 24 can be a single line scanner comprised of LED emitters and photodetectors or a camera that generates two dimensional images. Rollers 42 and 46 are provided to maintain tension in the web W and they can be movable to adjust the tension in the web in a known manner.

Each printhead 50A, 50B, 50C, and 50D in the first print zone 26 is operatively connected to a corresponding printhead driver 54A, 54B, 54C, and 54D and the controller 14 is operatively connected to these printhead drivers. Each printhead 58A, 58B, 58C, and 58D in the second print zone 30 is also operatively connected to a corresponding printhead driver 62A, 62B, 62C, and 62D and the controller 14 is operatively connected to these printhead drivers. Following each of the printheads 50A, 50B, 50C, and 50D in the first print zone 26 is a UV radiation source 66A, 66B, 66C, and 66D and the controller 14 is operatively connected to each one of the radiation sources. These radiation sources emit UV radiation at a wavelength of 395 nm. Each UV radiation source 66A, 66B, 66C, and 66D follows the printhead preceding the UV radiation source in the process direction by a predetermined distance in which the UV curable ink ejected by the immediately preceding printhead is fixed by the UV radiation source before the UV curable ink ejected by the immediately preceding printhead passes the UV radiation source. As used in this document, the term "fixed" means that the UV curable ink does not expand beyond the landing area of a UV curable ink drop by more than a predetermined toleration parameter. In one embodiment, this toleration parameter is about twice a diameter of a nominal UV curable ink drop. The number of printheads in the first print zone and the number of printheads in the second print zone are the same and the inkjets in the printheads in the second print zone are aligned in the process direction with the inkjets in the corresponding printheads in the first print zone. That is, an ink drop ejected by an inkjet in a printhead ejecting a particular color of ink in the first print zone passes directly underneath the corresponding inkjet of the printhead ejecting the same color of ink in the second print zone. This configuration enables the two printheads of the same color in the different print zones to provide a backup for each inkjet in the two printheads. If an inkjet in one of these two print zones becomes inoperative, then the corresponding inkjet in the corresponding color printhead in the other print zone can eject a drop to replace the missing ink drop. Thus, the printheads in the second print zone are not positioned to increase the resolution of the number of drops in a line that can be formed by the printheads in the cross-process direction.

The controller 14 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

Figure 2:
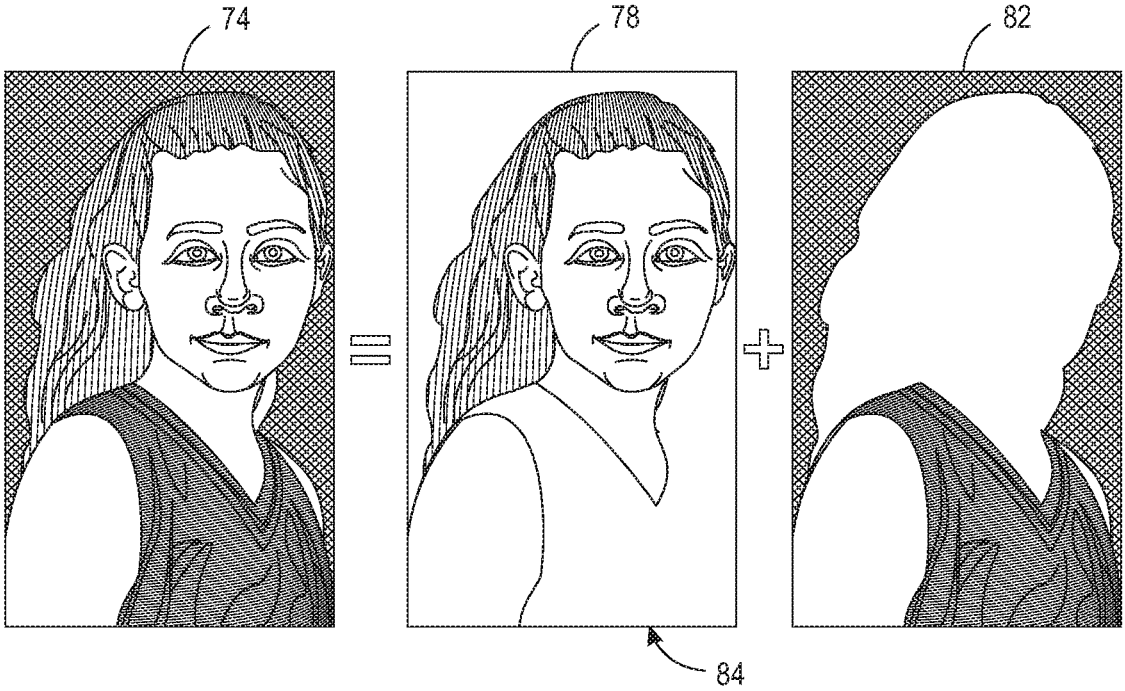
FIG. 2 illustrates a process for processing an image into different data files useful for operating the printer of FIG. 1.

The controller 14 is operatively connected to an image source 70. Image source 70 can be a scanner, database, or other image generation or data source. An image that the controller 14 obtains from the image source 70 is used to operate the printer 10 to form an ink image on the web W corresponding to the obtained image. The controller 14 processes the image obtained from the image source in the following manner for control of the printhead drivers 54A to 54D and 62A to 62D. As shown in FIG. 2, a composite image 74 is obtained from the image source 70. As used in this document, the term "composite image" refers to pixel data for each color present in an image that forms every component in the image. The composite image 74 includes features file 78, which contains the pixels that form detailed features in the image, and a solid features file 82, which contains the pixels that form the primarily solid areas in the image. To produce the two files, a bitmap image to be printed is segmented into areas and the average density of the pixels in the area is determined. This average is compared to a predetermined density threshold. Those areas having an average pixel density that is greater than the threshold are identified as areas for the solid areas file 82, while those having a density that is equal to or less than the threshold are identified as areas for the fine features file 78. In the example shown in FIG. 2, the solid areas correspond to a uniform and background in the image. A solid perimeter 84 is added to the features file 78 to constrain the flow of solids at the edges of the image. The controller processes the composite image 74 to produce the features file 78 and the solid features file 82 and then each of these files is then processed by the controller 14 to produce color separation files that correspond to the colors of ink ejected by the printheads in the two print zones. Additional processing can also occur in a known manner such as halftoning and the like. The color separation files derived from the features file 78 are supplied to the printhead driver corresponding to the printhead in the first print zone 26 that corresponds to the color contained in the color separation file. For example, the black color separation file derived from the features file 78 is delivered to the printhead driver 54A, which operates the printhead 50A that ejects black ink. As used in this document, the term "print zone" means an area directly opposite a plurality of printheads that forms an ink image on a substrate either using a fine features file or a solid areas file but not both. The term "process direction" means the direction in which media moves through the print zone or print zones as the inkjets eject ink onto the sheets and the term "cross-process direction" means an axis that is perpendicular to the process direction in the plane of the media in the print zone or print zones.

Figure 3:
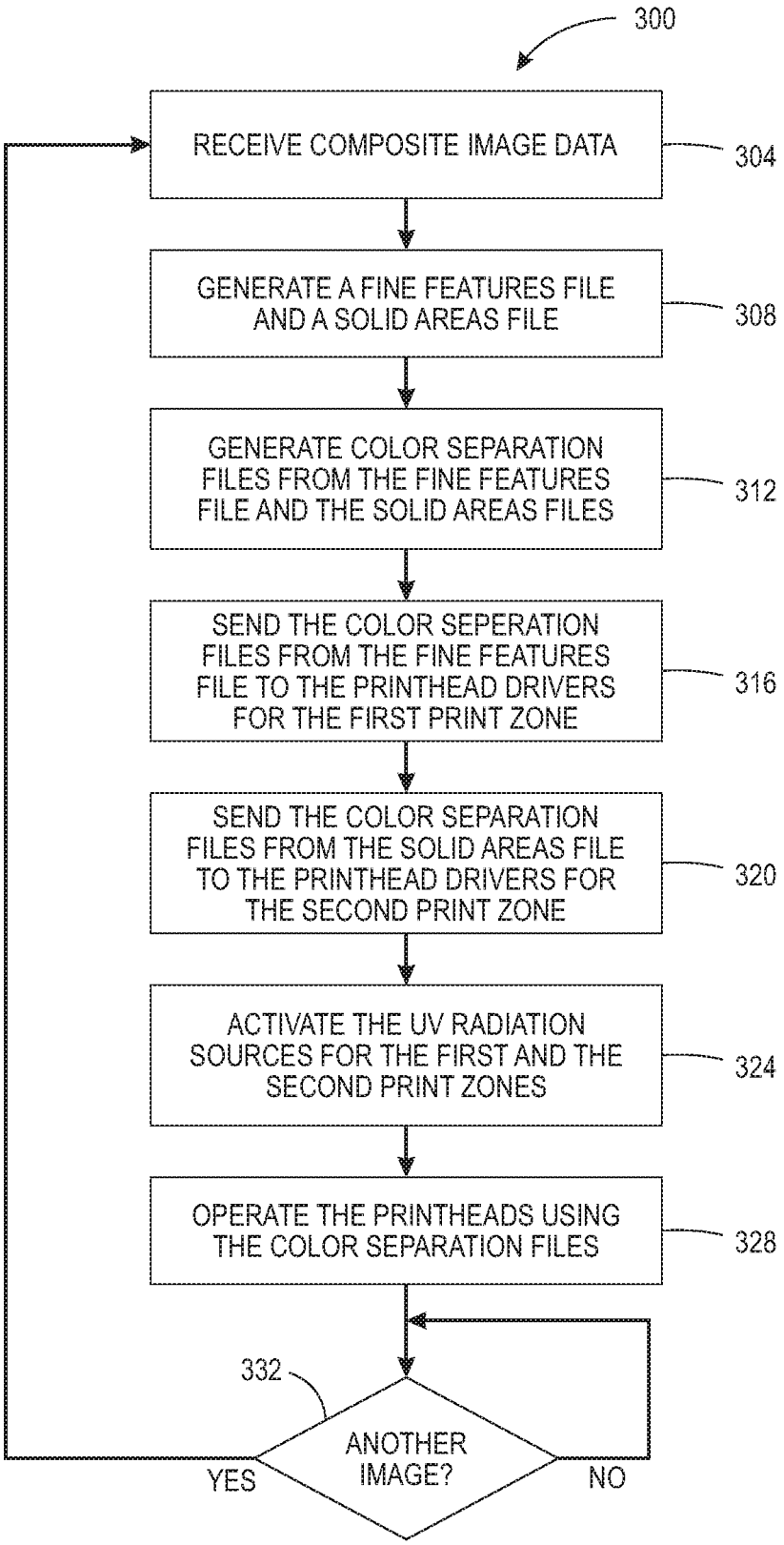
FIG. 3 depicts a process for operating the printer of FIG. 1.

A process for operating the printer shown in FIG. 1 is shown in FIG. 3. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 14 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

FIG. 3 is a flow diagram of a process 300 that operates the printing system 10 to provide varying degrees of UV radiation exposure at different times during image printing to improve the sharpness of fine image features and to establish uniform solid areas with accurate formation of colors in those areas. The process 300 begins by receiving a composite image file (block 304). The controller then generates a fine features file and a solid areas file from the composite image file (block 308). Color separation files are generated from the fine features file and the solid areas file (block 312). The color separation files generated from the fine features file are sent to the printhead drivers that operate the printheads in the first print zone (block 316) and the color separation files generated from the solid areas file are sent to the printhead driers that operate the printheads in the second print zone (block 320). The UV radiation sources for the first print zone and the second print zone are activated (block 324). The printhead drivers then operate the printheads in the first and the second print zones using the color separation files to form the fine features image on the web in the first print zone and to form the solid areas on the web in the second print zone (block 328). As the printed images pass the optical sensor, image data of the printed images are generated and analyzed by the controller (block 332). If the image data indicates that the fine features printed image is too grainy, then the intensity of the sources of UV radiation for the first print zone are increased and if the image data indicates that the solid areas printed image is too streaky, then the intensity of the sources of UV radiation for the second print zone are decreased (block 336). As used in this document, the term "grainy" means an uneven distribution of ink across fine features in the image and the term "streaky" means alternating light and dark lines in the solid areas in the image. If no additional images are available for printing (block 340), the process waits until another image is ready for printing. At that time, the process obtains the composite image (block 304) and the process repeats.

By operating the printheads in the first print zone using the color separations derived from the fine features image data file while the UV radiation sources are operating, each color separation corresponding to the fine features file is separately cured so the ink is quickly fixed in place. This combination of printing and exposing the image to UV radiation is effective for preserving fine feature detail since the ink is not permitted to flow over the surface of the substrate W or to combine with neighboring deposited drops in a way that forms uncontrolled shapes that make the image grainy. The printheads operated in the second print zone using the color separations derived from the fine features image data file while the UV radiation sources separated from the second print zone by the predetermined distance D are operating, enables the inks to flow and more uniformly cover the solid printed areas corresponding to the solid areas file. This combination of printing and waiting to expose the solid areas image to UV radiation is effective for forming more uniform solid areas since the ink is permitted to flow over the surface of the substrate W before UV radiation exposure.

Figure 4:
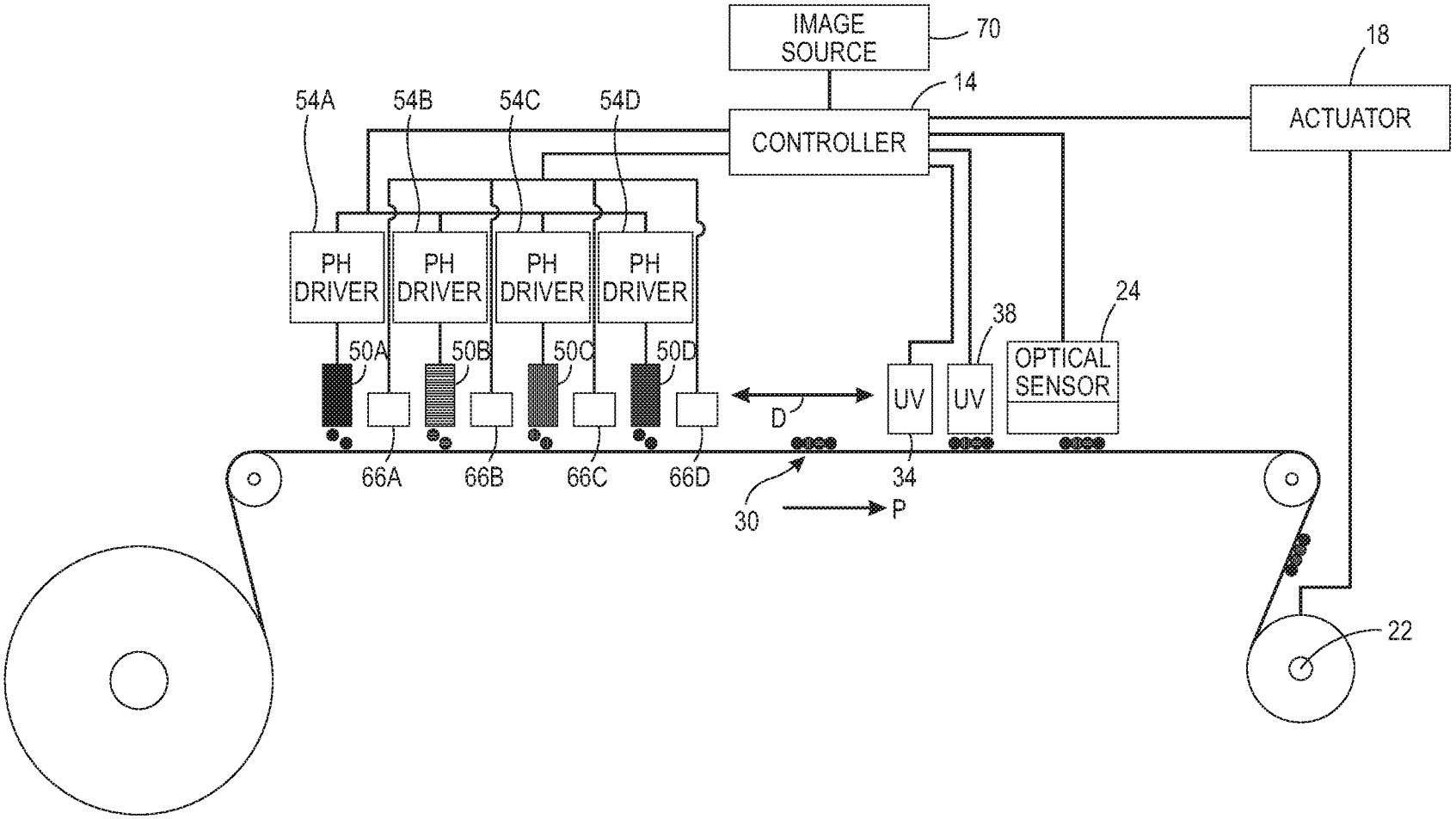
FIG. 4 depicts an alternative embodiment of the printer shown in FIG. 1.

An alternative embodiment of printer 10 is shown in FIG. 4. This printer 10' includes all the components of printer 10 except the second set of printheads 58A, 58B, 58C, and 58D and the second set of printhead drivers 62A, 62B, 62C, and 62D. Additionally, the UV source of radiation 34, which emits UV radiation at a wavelength of 365 nm, is separated from UV source 66D by the distance D and the UV source of radiation 38, which emits UV radiation at a wavelength of 395 nm, follows UV source 34 as depicted in FIG. 1. Each one of the UV radiation sources 66A, 66B, 66C, and 66D is an array of small UV emitters, such as UV light emitting diodes (LEDs), that cover the cross-process direction width of the print zone 26. The UV emitters emit UV radiation at a wavelength of 395 nm. Each UV emitter in each UV source 66A to 66D can be independently operated by the controller 14 through a switching network or the like. Because only one print zone is provided in the alternative embodiment, the composite image is used to operate the printheads 50A to 50D. The composite image, however, is still used as described above to generate fine features data only. The fine features data is used by the controller 14 to operate independently the UV emitters of UV sources 66A to 66D so only the areas of the image containing fine features that were printed by the printhead preceding each UV source are exposed to UV radiation from the UV emitters of the UV source following a printhead in the process direction. In this manner, the ink from the printheads that form fine features is fixed following ejection onto the web W while the solid areas printed by the printheads can spread until the image reaches UV source 34. Both UV source 34 and UV source 38 are flood UV sources, which means they emit UV radiation uniformly across the entire width of the web Win the cross-process direction as the image passes these UV sources. Thus, the solid areas are fixed by these UV sources, first, at the underlying layers by the UV source 34 and then at the upper layers by the UV source 38.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a first printhead operatively connected to a source of ultraviolet (UV) curable ink having a first color, the printhead being configured to eject the UV curable ink having the first color onto a substrate as the substrate passes the printhead in a process direction;

a first source of UV radiation following the first printhead in the process direction by a first predetermined distance so the UV curable ink ejected by the first printhead is fixed by the UV radiation from the first source of UV radiation before the substrate moves past the first source of UV radiation;

a second printhead operatively connected to the source of UV curable ink having the first color, the second printhead being positioned to eject the UV curable ink having the first color onto the substrate after the first printhead has ejected the UV curable ink having the first color onto the substrate and the first source of UV radiation exposes the UV curable ink ejected by the first printhead to UV radiation; and a second source of UV radiation following the second printhead in the process direction and being separated from the second printhead in the process direction by a second predetermined distance that is greater than the first predetermined distance so the UV curable ink ejected by the second printhead spreads over a portion of the substrate before the second source of UV radiation fixes the UV curable ink ejected by the second printhead to the substrate.

2. The printer of claim 1 further comprising:

a controller operatively connected to the first printhead, the second printhead, the first source of UV radiation, and the second source of UV radiation, the controller being configured to receive composite image data, generate fine features data and solid areas data using the composite image data, operate the first printhead with the fine features data, and operate the second printhead with the solid areas data.

3. The printer of claim 2 further comprising:

a first plurality of printheads that includes the first printhead but not the second printhead, each printhead in the first plurality of printheads being operatively connected to a source of UV curable ink that has a different color than the other sources of UV curable ink to which the other printheads in the first plurality of printheads are connected;

a first plurality of sources of UV radiation that includes the first source of UV radiation but not the second source of UV radiation, each source of UV radiation in the first plurality of sources of UV radiation follows one of the printheads in the first plurality of printheads in a one-to-one correspondence at the first predetermined distance; and the controller is operatively connected to each printhead in the first plurality of printheads and to each source of UV radiation in the first plurality of sources of UV radiation, the controller being further configured to generate a first plurality of color separations from the fine features data, each color separation corresponding to one of the colors of the UV curable ink sources in a one-to-one correspondence, and operate the printheads in the first plurality of printheads with the color separation that corresponds to the color of the UV curable ink to which the printhead in the first plurality of printheads is connected.

4. The printer of claim 3 further comprising:

a second plurality of printheads that includes the second printhead but not the first printhead, the second plurality of printheads having a number of printheads that equals the number of printheads in the first plurality of printheads and each printhead in the second plurality of printheads being operatively connected to one of the sources of UV curable ink in a one-to-one correspondence so that one printhead in the first plurality of printheads and one printhead in the second plurality of printheads are operatively connected to a same source of UV curable ink having a same color in the one-to-one correspondence; and the controller is operatively connected to each printhead in the second plurality of printheads, the controller being further configured to generate a second plurality of color separations from the solid areas data, each color separation in the second plurality of color separations corresponding to one of the colors of the UV curable ink sources in the one-to-one correspondence, and operate the printheads in the second plurality of printheads with the color separation generated from the solid areas data that corresponds to the color of the UV curable ink to which the printhead in the second plurality of printheads is connected.

5. The printer of claim 4 wherein the printheads in the second plurality of printheads and the printheads in the first plurality of printheads are aligned in the process direction so inkjets in each of the printheads in the first plurality of printheads are aligned with inkjets in the printhead in the second plurality of printheads that is connected to the same source of the same color of UV curable ink.

6. The printer of claim 5 further comprising:

a third source of UV radiation that follows the second source of UV radiation in the process direction.

7. The printer of claim 6 wherein the second source of UV radiation emits UV radiation of a first wavelength and the third source of UV radiation emits UV radiation of a second wavelength, the first wavelength and the second wavelength being different.

8. The printer of claim 7 further comprising:

an optical sensor positioned in the process direction after the substrate has passed the second source of UV radiation and the third source of UV radiation, the optical sensor being configured to generate image data of printed images on the substrate; and the controller is configured to detect grainy areas and streaky areas in the image data of the printed images.

9. The printer of claim 8, the controller being further configured to decrease an intensity of the sources of UV radiation in the first plurality of sources of UV radiation when streaky areas are detected in the image data of the printed images.

10. The printer of claim 8, the controller being further configured to increase an intensity of the second source of UV radiation and the third source of UV radiation when grainy areas are detected in the image data of the printed images.

11. A method of operating a printer comprising:

operating with a controller a first source of UV radiation that follows a first printhead in a process direction by a first predetermined distance to fix UV curable ink ejected by the first printhead onto a substrate before the substrate moves past the first source of UV radiation; and operating with a controller a second source of UV radiation following a second printhead in the process direction that is separated from the second printhead in the process direction by a second predetermined distance that is greater than the first predetermined distance to fix the UV curable ink ejected by the second printhead after the UV curable ink spreads over a portion of the substrate.

12. The method of claim 11 further comprising:

receiving composite image data with a controller operatively connected to the first printhead, the second printhead, the first source of UV radiation, and the second source of UV radiation;

generating with the controller fine features data and solid areas data using the composite image data;

operating the first printhead with the controller using the fine features data; and operating the second printhead with the controller using the solid areas data.

13. The method of claim 12 further comprising:

operating with the controller a first plurality of sources of UV radiation that includes the first source of UV radiation but not the second source of UV radiation, each source of UV radiation in the first plurality of sources of UV radiation follows a printhead in a first plurality of printheads that includes the first printhead but not the second printhead in a one-to-one correspondence at the first predetermined distance, each printhead in the first plurality of printheads being operatively connected to a source of UV curable ink that has a different color than the other sources of UV curable ink to which the other printheads in the first plurality of printheads are connected;

generating with the controller that is further operatively connected to each printhead in the first plurality of printheads and to each source of UV radiation in the first plurality of sources of UV radiation a first plurality of color separations from the fine features data, each color separation corresponding to one of the colors of the UV curable ink sources in a one-to-one correspondence; and operating with the controller the printheads in the first plurality of printheads with the color separation that corresponds to the color of the UV curable ink to which the printhead in the first plurality of printheads is connected.

14. The method of claim 13 further comprising:

generating a second plurality of color separations from the solid areas data with the controller that is further operatively connected a second plurality of printheads that includes the second printhead but not the first printhead, the second plurality of printheads having a number of printheads that equals the number of printheads in the first plurality of printheads and each printhead in the second plurality of printheads being operatively connected to one of the sources of UV curable ink in a one-to-one correspondence so that one printhead in the first plurality of printheads and one printhead in the second plurality of printheads are operatively connected to a same source of UV curable ink having a same color in the one-to-one correspondence, and each color separation in the second plurality of color separations corresponding to one of the colors of the UV curable ink sources in the one-to-one correspondence; and operating with the controller the printheads in the second plurality of printheads with the color separation that corresponds to the color of the UV curable ink to which the printhead in the second plurality of printheads is connected.

15. The method of claim 14 further comprising:

operating with the controller inkjets in each of the printheads in the first plurality of printheads to provide UV curable ink corresponding to inoperative inkjets in each of the printheads in the second plurality of printheads, the inkjets in each of the printheads in the first plurality of printheads are aligned with inkjets in the printhead in the second plurality of printheads that is connected to the same source of the same color of UV curable ink.

16. The method of claim 15 further comprising:

operating with the controller inkjets in each of the printheads in the second plurality of printheads to provide UV curable ink corresponding to inoperative inkjets in each of the printheads in the first plurality of printheads.

17. The method of claim 16 further comprising:

operating with the controller a third source of UV radiation that follows the second source of UV radiation in the process direction and that emits UV radiation of a first wavelength, the controller being further operatively connected to the third source of UV radiation; and operating with the controller the second source of UV radiation that emits UV radiation of a second wavelength, the first wavelength and the second wavelength being different.

18. The method of claim 17 further comprising:

operating with the controller an optical sensor positioned in the process direction after the substrate has passed the second source of UV radiation and the third source of UV radiation, the optical sensor being configured to generate image data of printed images on the substrate; and detecting with the controller grainy areas and streaky areas in the image data of the printed images.

19. The method of claim 18 further comprising:

decreasing with the controller an intensity of the sources of UV radiation in the first plurality of sources of UV radiation when streaky areas are detected in the image data of the printed images.

20. The method of claim 18 further comprising:

increasing with the controller an intensity of the sources of UV radiation in the second source of UV radiation and the third source of UV radiation when grainy areas are detected in the image data of the printed images.

21. A printer comprising:

a first printhead operatively connected to a source of ultraviolet (UV) curable ink having a first color, the first printhead being configured to eject the UV curable ink having the first color onto a substrate as the substrate passes the first printhead in a process direction;

a first source of UV radiation following the first printhead in the process direction by a first predetermined distance, the first source of UV radiation being configured with a plurality of UV emitters that are independently operable so at least one UV emitter is operated to expose at least one area of the substrate printed with the UV curable ink ejected by the first printhead to fix the UV curable ink in the at least one area before the substrate moves past the first source of UV radiation and the UV curable ink ejected by the first printhead on at least one other area of the substrate spreads as the substrate passes the first source of UV radiation; and a second source of UV radiation following the first source of UV radiation in the process direction and being separated from the first source of UV radiation in the process direction by a second predetermined distance that is greater than the first predetermined distance, the second source of UV radiation being configured to expose an entire width of the substrate in a cross-process direction so the UV curable ink ejected by the first printhead in the at least one other area is fixed as the substrate passes the second source of UV radiation.

22. The printer of claim 21 further comprising:

a controller operatively connected to the first printhead, the first source of UV radiation, and the second source of UV radiation, the controller being configured to receive composite image data, generate fine features data using the composite image data, operate the first printhead with the composite image data, and operate the first source of UV radiation with the fine features data.

23. The printer of claim 22 further comprising:

a plurality of sources of UV curable ink including the source of UV curable ink having the first color, each source of UV curable ink has a different color than the other sources of UV curable ink in the plurality of UV curable inks;

a plurality of printheads that includes the first printhead, each printhead in the plurality of printheads being operatively connected to one of the sources in the plurality of sources of UV curable ink in a one-to-one correspondence;

a plurality of sources of UV radiation that includes the first source of UV radiation but not the second source of UV radiation, each source of UV radiation in the plurality of sources of UV radiation follows one of the printheads in the plurality of printheads in the process direction in a one-to-one correspondence at the first predetermined distance and each source of UV radiation in the plurality of sources of UV radiation are configured with a plurality of UV emitters that are independently operable so at least one UV emitter following the corresponding printhead in the plurality of printheads is operated to expose at least one area of the substrate printed with the UV curable ink ejected by the corresponding printhead to fix the UV curable ink ejected in the at least one area before the substrate moves past the source of UV radiation following the printhead that ejected the UV curable ink into the at least one area and the UV curable ink ejected by the corresponding printhead onto at least one other area of the substrate spreads as the substrate passes the source of UV radiation following the corresponding printhead; and the controller is operatively connected to each printhead in the plurality of printheads and to each source of UV radiation in the plurality of sources of UV radiation, the controller being further configured to generate a plurality of color separations from the fine features data, each color separation corresponding to one of the colors of the sources of the UV curable ink in a one-to-one correspondence, and operate each source of UV radiation in the plurality of sources of UV radiation with the color separation that corresponds to the color of the UV curable ink ejected by the printhead preceding the source of UV radiation.

24. The printer of claim 23 further comprising:

a third source of UV radiation that follows the second source of UV radiation in the process direction.

25. The printer of claim 24 wherein the second source of UV radiation emits UV radiation of a first wavelength and the third source of UV radiation emits UV radiation of a second wavelength, the first wavelength and the second wavelength being different.

26. The printer of claim 25 further comprising:

an optical sensor positioned in the process direction after the substrate has passed the second source of UV radiation and the third source of UV radiation, the optical sensor being configured to generate image data of printed images on the substrate; and the controller is configured to detect grainy areas and streaky areas in the image data of the printed images.

27. The printer of claim 26, the controller being further configured to decrease an intensity of the sources of UV radiation in the plurality of sources of UV radiation when streaky areas are detected in the image data of the printed images.

28. The printer of claim 26, the controller being further configured to increase an intensity of the second source of UV radiation and the third source of UV radiation when grainy areas are detected in the image data of the printed images.

* * * * *